United States Patent [19]

Forman, Jr. et al.

[11] Patent Number: 4,840,335

[45] **Date of Patent: * Jun. 20, 1989**

[54] HOLDING ARRANGEMENT FOR LOADING PLASTIC BAGS

[75] Inventors: Edward W. Forman, Jr., Palmyra; Alexander R. Provan, Canandaigua; Ronald R. Schmieder, Fairport, all of N.Y.

[73] Assignee: Mobil Oil Corporation, New York, N.Y.

[ * ] Notice: The portion of the term of this patent subsequent to Dec. 11, 2001 has been disclaimed.

[21] Appl. No.: 713,432

[22] Filed: Mar. 19, 1985

[51] Int. Cl.[4] ..... B65B 67/04

[52] U.S. Cl. ..... 248/97; 248/99

[58] Field of Search ..... 248/97, 99, DIG. 12

[56] References Cited

U.S. PATENT DOCUMENTS

| | | | |
|---|---|---|---|
| 810,329 | 1/1906 | Dyett . | |
| 1,351,094 | 8/1920 | Buckel . | |
| 1,653,393 | 12/1927 | Cox . | |
| 3,260,488 | 7/1966 | Kliewer . | |
| 3,707,826 | 1/1973 | Cole . | |
| 3,747,298 | 7/1973 | Lieberman . | |
| 3,840,092 | 10/1974 | Close . | |
| 3,905,406 | 9/1975 | Cruse . | |
| 4,062,170 | 12/1977 | Orem . | |
| 4,458,867 | 7/1984 | Malik | 248/99 |
| 4,487,388 | 12/1984 | Provan | 248/99 |

FOREIGN PATENT DOCUMENTS

| | | |
|---|---|---|
| 1950868 | 5/1971 | Fed. Rep. of Germany . |

*Primary Examiner*—J. Franklin Foss
*Assistant Examiner*—Robert A. Olson
*Attorney, Agent, or Firm*—Alexander J. McKillop; Charles J. Speciale

[57] ABSTRACT

A bag holding arrangement which facilitates the loading or products, such as groceries or general merchandise, into upwardly opening bags incorporating handle loops spaced about the mouth of the bag. The arrangement enables plastic bags of different sizes; in effect, possessing different bag lengths and loading capacities, to have their handle loops selectively mounted on tabs arranged at different locations on the structure in conformance with the size of the bag which is desired to be utilized.

11 Claims, 4 Drawing Sheets

HOLDING ARRANGEMENT FOR LOADING PLASTIC BAGS

BACKGROUND OF THE INVENTION

1. Field of the Invention

The present invention relates to a bag holding arrangement, and more particularly, to a holding arrangement which facilitates the loading of products, such as groceries or general merchandise, into upwardly opening bags incorporating handle loops spaced about the mouth of the bag.

2. Discussion of the Prior Art

A traditional and long-accepted method for packaging merchandise, such as groceries at the check-out counters of grocery stores, has involved the loading of individual paper bags, a process which is quite frequently inefficient, time-consuming and expensive. The person implementing the bagging retrieves a bag from a stack, often from below a counter, normally opens it by a quick motion of the arm causing air to catch in the bag and distend it, and then positions the bag upright on the counter. In the case of double bagging operations, a second bag must be opened in the same manner and then inserted inside the first bag to provide extra strength. The merchandise, e.g., groceries, is then placed into tee open bag and the filled bags are slid across the counter so that the customers can put their arms around the middle of the bags and carry them out. Often, moisture absorption from the products contained within the heavily ladened bags will weaken the bottoms thereof, tending to cause them to separate or tear.

The general concept of packaging items in plastic bags is well known. However, thin plastic bags are very limp in nature and this characteristic not only adversely affects the loading operation, but any attempt to carry such a bag, loaded with groceries, by grasping the mid-portion thereof proves to be very awkward because of the limp film's tendency to allow the upper portion of the bag to fold over, usually with disastrous consequences.

Recent attempts to remedy these deficiencies of plastic bags have included the provision on the bag of handles adjacent to the mouth of the bag. This has helped to alleviate the carrying problem, but the loading operation raises a problem because of the difficulties attendants have in loading a limp plastic bag which is not self-supporting. Elaborate devices have been used to open and support the empty bags, such as blowers which fill the bag with air and vacuum systems which hold the walls of the bag apart and upright, but these can be expensive, require substantial redesign and modification of check-out counters and are subject to mechanical breakdown during heavy use. Although semi-rigid plastic films, such as vinyl, high density polyethylene and high modulus laminary structures formed therefrom, are available and could be used to construct bags which are self-supporting, the cost of such material is far beyond the relative costs of paper packaging materials and therefore, although a potential solution, is one which is economically unattractive.

U.S. Pat. No. 4,062,170, which is assigned to the common assignee for the present invention, provides an effective holder for loading plastic bags having handle loops. In this patent, a user removes the topmost bag from a stack of bags supported at the rear of the holder, places each of the handle loops of the bag on a respective one of spaced arm portion tabs, loads the bag, and removes the loaded bag from the holder by lifting the handle loops from the tabs.

Wire rack versions of the holder disclosed in U.S. Pat. No. 4,062,170 have been commercialized. These wire racks generally had the wire components welded together. Such wire racks were subject to failure at weld points where twisting or rocking forces were encountered due to flexing of the rack under stress during the loading of bags supported thereon.

However, more recently issued U.S. Pat. No. 4,487,388, which is also assigned to the common assignee of the present invention, discloses an improved holder for plastic bags which facilitates the loading thereof with product, and which is constituted of a rigid, high-strength wire construction which extensively overcomes the problems encountered with other prior art wire rack bag holders.

Both of the above-mentioned patents, although obviating many of the drawbacks encountered in prior art plastic bag holding and loading structures, are primarily designed to function in conjunction with bags of one predetermined size. In essence, most plastic bags currently utilized in the bagging of groceries in supermarkets are of the so-called 1/6 BBL. (equivalent) size; possessing overall lay flat dimensions of about 12in.-$\times$8in.$\times$23¼in. Consequently, the height of any bag mounting tabs in the bag holding arrangements above any lower support plate or surface must be dimensioned so as to allow the bottom of the opened bag to rest thereon during loading, in order to reduce the possibility of any heavy or sharp-edged objects being placed into the bag puncturing and tearing through the bottom of the bag rendering the latter unusable.

However, quite frequently, customers shopping in groceries or supermarkets only purchase a few items, which are usually bagged at so-called "Express" check-out counters, and which could be economically loaded into smaller-sized plastic bags; for instance, of ⅛BBL. or 1/7 BBL. (equivalent) capacities. Such smaller plastic bags which are, respectively, 5 in. and 2¾in. shorter in. length than the 1/6 BBL. plastic bags, require considerably less material in their manufacture, so as to render them much more economical in use. Inasmuch as these smaller-sized bags are shorter, in order afford them a bottom support during loading, the distance between the tabs and the lower supporting surface must, of necessity, be shorter than that for the support of the 1/6 BBL. plastic bags in the current holding arrangements.

SUMMARY OF THE INVENTION

The presently proposed bag holding arrangement pursuant to the invention solves the foregoing problem by employing a bag mounting and loading structure in a holder of the type described in U.S. Pat. No. 4,487,388, the disclosure of which is incorporated herein by reference, which enables plastic bags of different sizes; in effect, possessing different bag lengths and loading capacities, to have their handle loops selectively mounted on tabs arranged at different or lower locations on the structure in conformance with the size of the plastic bag which is desired to be utilized.

In accordance with the present invention, there is provided a holding arrangement for facilitating loading of articles in a plastic bag removed from a stack of bags. Each of the bags has an open mouth and integral upwardly extendable handle loops disposed on opposite sides of the mouth. The holding arrangement comprises a pair of spaced mirror-imaged side members, each being formed with a continuous wire bent to provide a vertical rear portion, an arm portion extending forwardly from the upper end of the rear portion, and a base portion extending forwardly from the lower end of the rear portion. The arm portion is formed into an upwardly extending horizontally elongated tab with a rearwardly projecting protrusion, a forwardly extending nose and a downwardly and rearwardly extending first support terminating at one end of the wire. A second downwardly depending tab inclined relative to the horizontal is formed in the downwardly and rearwardly extending support. The base portion is formed into horizontally extending parallel rails with a second support extending upwardly from the rear end of the upper one of the rails. The second support terminates at the other end of the wire. The other end of the wire is crimped about the first support.

The holding arrangement comprises a brace member formed from another continuous wire bent to provide a side-to-side stiffening portion interconnecting the lower ends of the vertical rear portions of the side members, and a pair of mirror-imaged load absorbing portions. Each of the load absorbing portions terminates at a respective end of the wire, and is connected to the bottom of a respective one of the second supports. The holder additionally comprises means interconnecting the vertical rear portions at the upper ends thereof for holding a stack of bags, and means interconnecting each of the lower one of the rails for providing a horizontal support surface.

With the holding arrangement of the present invention, a user removes the topmost bag from a stack of bags, places each of the handle loops of the bag on a respective one of the upwardly extending arm portion tabs, loads the bag, and removes the loaded bag from the holder by lifting the hand loops from the tabs. Alternatively, when employing smaller-sized bags, the user places each of the handle loops of the bag about the depending second tabs on the downwardly and rearwardly extending support rather than on the upwardly extending tabs.

DESCRIPTION OF SPECIFIC EMBODIMENTS

Figure 1:
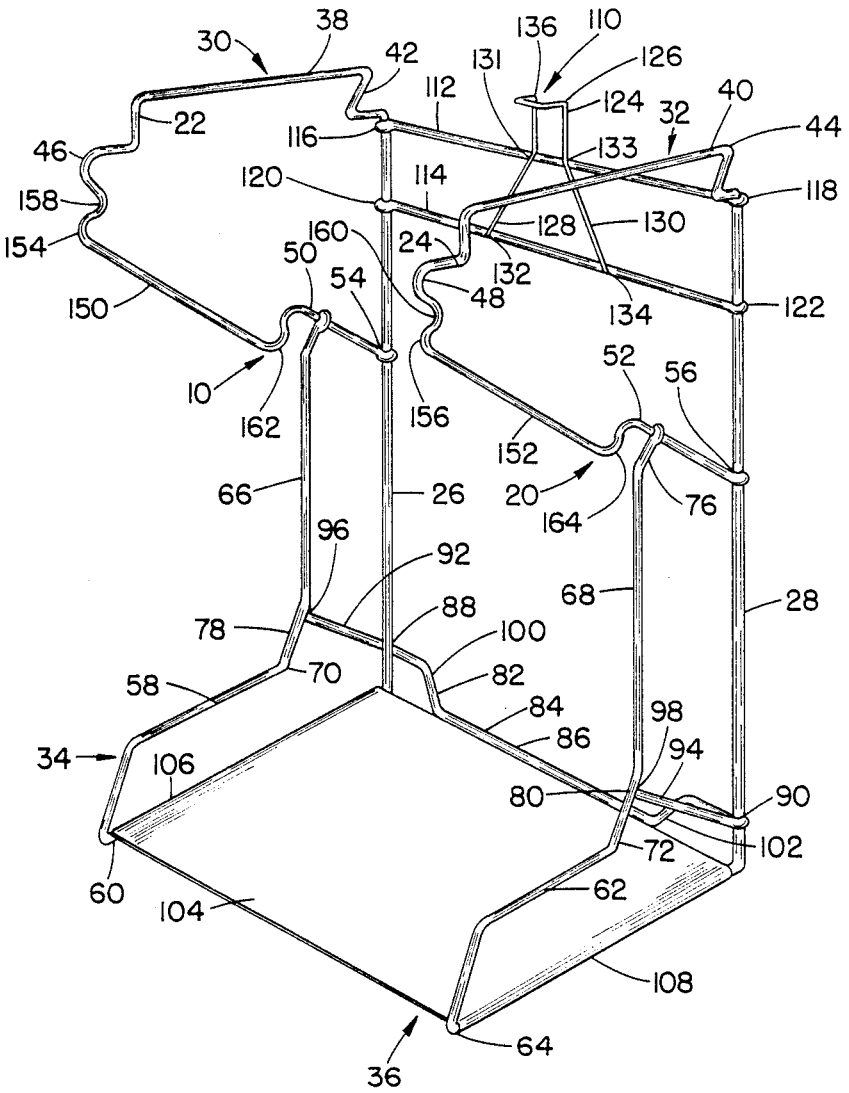
FIG. 1 is a perspective view of a holder embodiment for relatively tall bags in accordance with the present.
Figure 2:
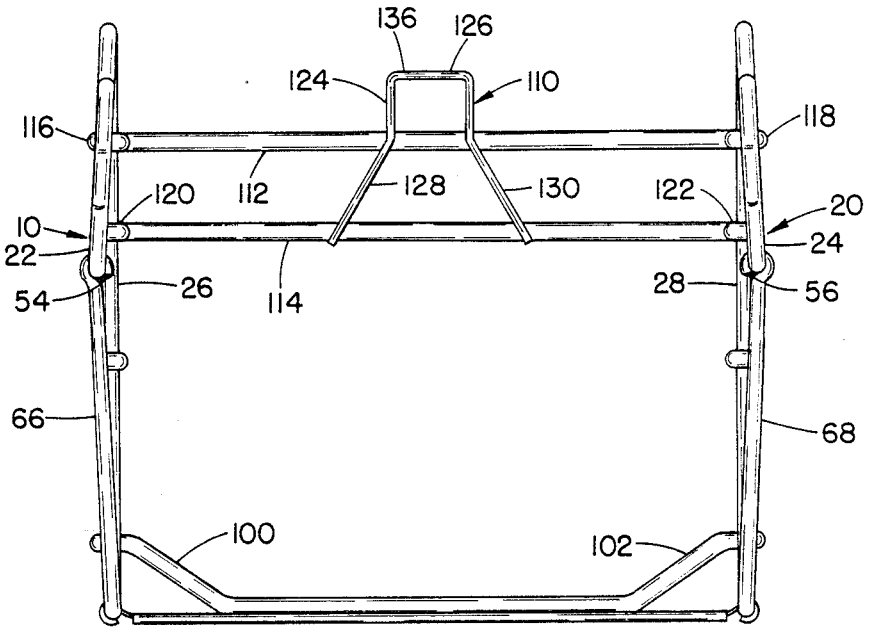
FIG. 2 is a front elevational view of another embodiment of a for shorter bags.
Figure 3:
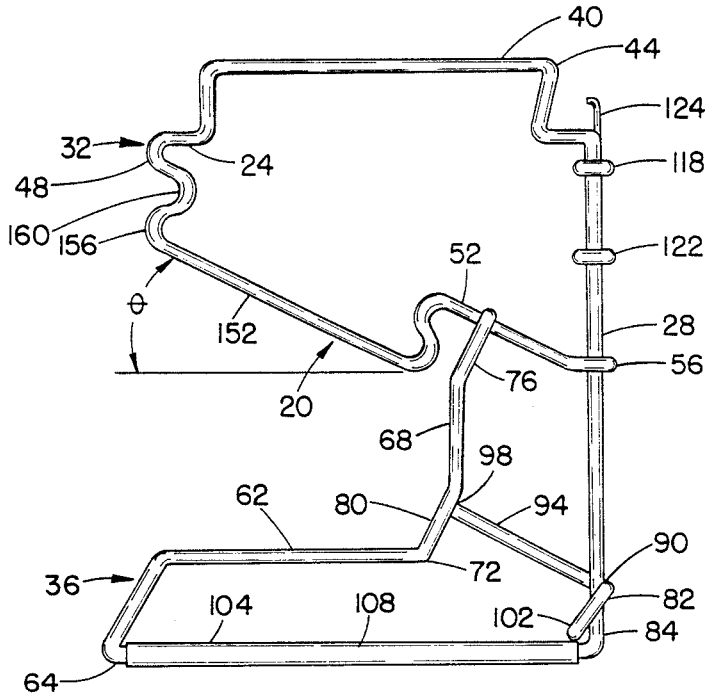
FIG. 3 is a side elevational view of the embodiment of FIG. 2.
Figure 4:
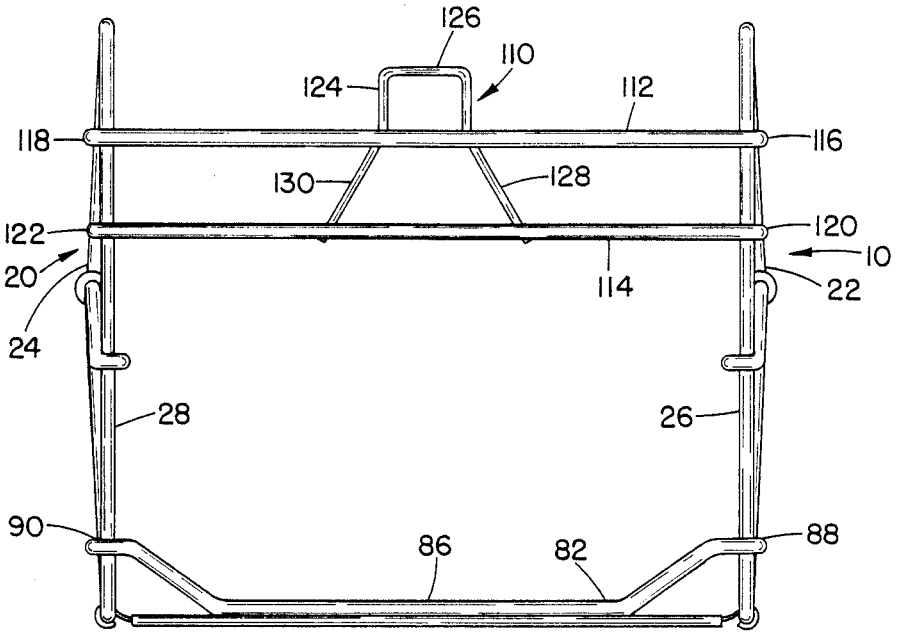
FIG. 4 is a rear elevational view of the embodiment of FIG. 2.
Figure 5:
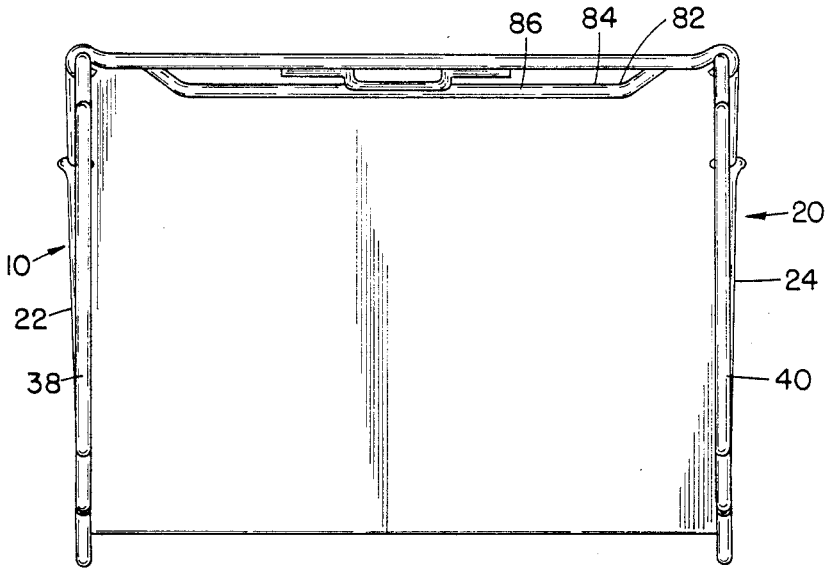
FIG. 5 is a top plan view of the embodiment of FIG. 2.

With reference to FIGS. 1 to 5, one form of the structure in accordance with the present invention provides a holding arrangement having a pair of spaced mirror-imaged side members 10, 20, each being formed with a single continuous wire 22, 24 bent to provide a vertical rear portion 26, 28, an arm portion 30, 32 extending forwardly from the upper end of the rear portion 26, 28, and a base portion 34, 36 extending forwardly from the lower end of the rear portion 26, 28.

The arm portion 30, 32, of each of the side members 10, 20 is formed into an upwardly extending horizontally elongated tab 38, 40 with a rearwardly projecting protrusion 42, 44, a forwardly extending nose 46, 48 and a downwardly and rearwardly extending first support 50, 52 which is bent to approach the vertical rear portions 26, 28 at a right angle, and terminates at one end 54, 56 of the wire 22, 24. The one end 54, 56 of the wire 22, 24 is crimped about the rear portion 26, 28 in a standard centered eye wire form.

A second elongated downwardly depending tab 150, 152 is formed in the downwardly and rearwardly extending first support 50, 52. The elongated portion of the tab 150, 152 is inclined downwardly towards the rear of the holding arrangement at an angle $\theta$ relative to the horizontal within the range of about 10° to 30°, and preferably within about 15° to 20° from the horizontal.

As shown in the embodiments of FIGS. 1 to 5, the forward end of the second tab 150, 152 may have the shape of forwardly curved protuberances 154, 156 located below the noses 46, 48 so as to provide a recess 158, 160 therebetween.

The reward end of the tab 150, 152 is in the shape of an "S", as identified by reference numeral 162, 164 to thereby provide the configuration of a protuberance.

Figure 6:
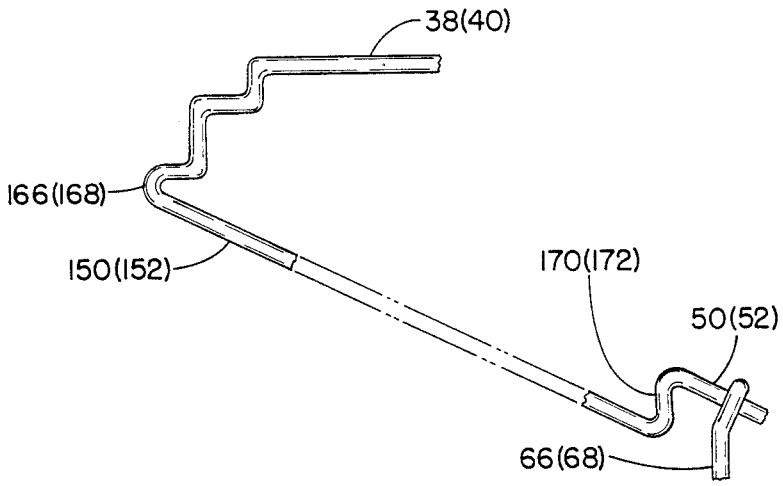
FIG. 6, on an enlarged scale, shows alternative shapes for the end or protuberances of the lower tabs for use with smaller-sized bags.

Alternatively, as shown in FIG. 6, left-hand end, the forward end of the tab 150, 152 may have a single protuberance 166, 168 connecting to a vertical wire portion leading to the first tab 38, 40. Moreover, the rearward end of the tab 150, 152, as shown at the right-hand end of FIG. 6, may have a vertical element 170, 172 extending upwardly to join the support 50, 52 rather than the S-shaped protuberance 162, 164.

The base portion 34, 36 of each one of the side members 10, 20 is formed into horizontally extending parallel rails 58, 60, 62, 64 with a second support 66, 68 extending upwardly from the rear end 70, 72 of the upper rails 58, 62. Each one of the second supports 66, 68 are bent at its upper end 74, 76 to approach the respective first support 50, 52 at a 90° angle. The lower end 78, 80 of each of the second supports 66, 68 is also bent downwardly and forwardly to provide a support surface for a brace member 82.

The brace member 82 is formed from a continuous wire 84 which is bent to provide a side-to-side stiffening portion 86 by welding at 88, 90 to the lower ends of the vertical rear portions 26, 28 of the side members 10, 20.

The brace member 82 also includes a pair of mirror-imaged load absorbing portions 92, 94 extending upwardly and forwardly for a perpendicular connection be welding at the ends 96, 98 to the support surfaces 78, 8 at the lower ends of the second supports 66, 68. Downwardly and forwardly extending portions 100, 102 interconnect the load absorbing portions 92, 94 and the side-to-side stiffening portion 86 of the brace member 82. Means in the form of a sheet metal shelf 104 interconnects the lower rails 60, 64 to provide a horizontal support surface for a bag. The outer ends 106, 108 of the shelf 104 are crimped about the lower rails 60, 64.

Means 110 interconnect the vertical rear portion 26, 28 at the upper ends thereof for holding a stack of bags 113 such as shown in FIG. 6.

The stack of bags holding means 110 is formed from a pair of vertically spaced parallel wires 112, 114 each having their respective outer ends 116, 118; 120, 122 crimped about the vertical rear portions 26, 28 of the side members 10, 20. Another wire 124 is bent to provide a loop 126 extending upwardly from the top wire 112 and a pair of trusses 128, 130 extending downwardly and outwardly from the top wire 112 to the bottom wire 114. The wire 124 is welded at points 131, 132, 133, 134 to the top and bottom wires 112, 114 to fix the relative position of the wires 112, 114 and thereby avoid lateral rocking of the holder. The top end of the loop 126 has a forwardly protruding portion 136 for insertion into the aperture 138 of the stack of bags 113 as shown in FIG. 6 to thereby support the stack 113 in the holder with the handle loops 140, 142 on opposite sides of the bag mouths 143 folded over the top wire 112.

Figure 7:
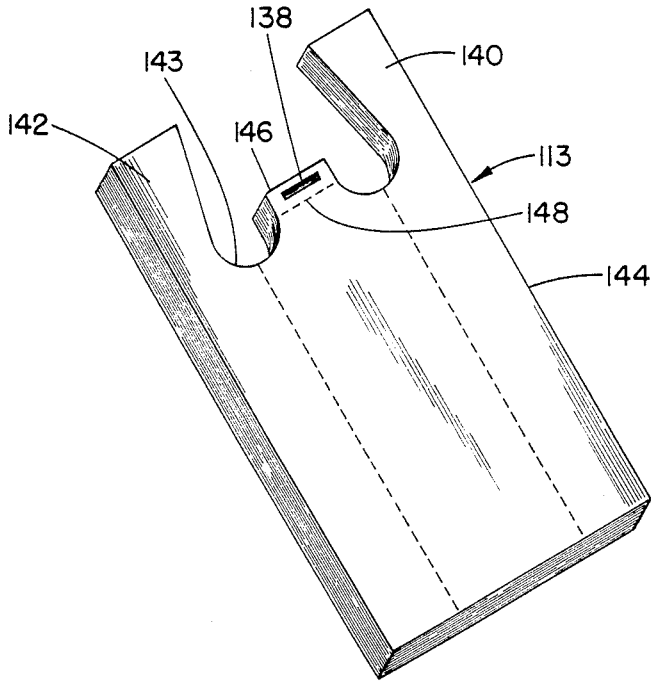
FIG. 7 shows one form of a stack of plastic bags which are loadable with articles by the holding arrangement of the present invention.

The stack of bags 113 shown in FIG. 7 is disclosed in U.S. Pat. No. 4,165,832, which patent is incorporated herein by reference. The bags 144 of the stack 113 each have a detachable tab member 146 attached to the bag 144 by horizontal perforations 148 formed during manufacture. The bags 144 are bonded together during manufacture by using a heated blade element (not shown) which is heated to a temperature to cause penetration of the blade through the tabs 146 to form the apertures 138 and also fuse the peripheral areas of the apertures 138 to bond the bags 144 together into the stack 113.

A user removes the topmost bag 144 from the stack of bags 113 and places each of the handle loops 140, 142 on a respective one of the arm portion tabs 38, 40 with the bottom 150 of the bag resting on the shelf 104. The user then loads the bag and removes the loaded bag from the holder by lifting the handle loops 140, 142 from the tabs 38, 40.

The foregoing procedure in loading the bag relates to the standard 1/6 BBL. (equivalent) grocery sack. However, when it is intended to load a shorten bag; in effect, a 1/7 or ⅛BBL. plastic bag, then the bag is pulled off from a stack of bags which may be positioned adjacent to the inventive bag holding arrangement, and the handle loops 140, 142 slipped upwardly from below onto a respective one of the tabs 150, 152. The angle $\theta$ of the tabs 150, 152 relative to the horizontal will ensure that the bag does not disengage inadvertently from the tabs during loading.

In the embodiment illustrated in FIGS. 1 to 5, the forward ends of the loops 140, 142 are engaged in the respective recesses 158, 160 of the tabs 150, 152 when loading a =BBL. sized bag. When loading a slightly longer 1/7 BBL. sized bag, the forward end of the loops can be slipped further upwardly over the protrusion 46, 48 to allow for the excess height over the base plate 104. The rearward end of the bag, in both instances, is engaged in the recess above the protrusion 162, 164. Subsequent to the loading of the bag, the handle loops 140. 142 are pulled downwardly so as to disengage from the tab 150. 152, and the loaded bag is removed.

As shown in FIG. 6, in a modified embodiment of the invention, the forward end of the tab 150, 152 may be provided with only a single protuberance 166, 168. Also, if desired, the rearward end of the tab 150. 152 may extend into a vertical portion 170, 172 instead of the protuberance 162, 164.

Thus, the present invention provide a holder having a wire body which avoids the use of welds where the holder is subject to twisting or rocking forces. Specifically, eye form joints are provided at the interconnection of the second supports 66, 68 with the first supports 50, 52; at the interconnection of the first supports of 50, 52 with the vertical rear portions 26, 28; and at the interconnections of the pair of parallel wires 112, 114 with the vertical rear portions 26, 28. These eye form joints permit some flexing of the rack under stress when bags 144 are being loaded in the holder, but are not subject to possible failure, as with a welded joint, under continued flexing.

The horizontally extending parallel rails 58, 60; 62, 64 of the base portions 34, 36 limit the bottom width of the bag as it is being packed. Thus, minimizing the possibility that the bottom bag is biased out during packing, which might result in the bottom of the bag tearing.

The brace member 82, as discussed hereinabove, stiffens the holder from side-to-side, and absorbs vertical loading applied to the elongated tabs 38, 40. The shelf 104 may be perforated to bolt the holder to any suitable support. A center bolt fastening through the shelf 104 permits the holder to be pivoted in any direction for packing.

The wires used in the holder of the present invention may be suitably formed of 9GA steel wire, and the shelf 014 may be formed of 16GA sheet steel. The shelf 104 may also have a rolled front edge to avoid the possibility of burrs.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

Although the bag holding arrangement has been described as being constituted of metallic wire, it is readily conceivable to one skilled in the art that it may be formed of other materials and with solid side and rear walls. These materials may consist of molded plastics, sheet metal, pressed fiberboard and/or suitable rigid and high-strength laminates.

What is claimed is:

1. A bag holding arrangement adapted to facilitate the loading of articles into a plastic bag selectively removable from stacks of differently sized bags, each said bag having an upwardly opening mouth and a pair of integral upwardly extending handle loops disposed on opposite sides of said mouth, said holding arrangement comprising:

a pair of spaced side members having a mirror-image configuration, each said side member being formed of wire bent to form a vertical rear portion, an arm portion extending forwardly from the upper end of said rear portion, and a base portion extending forwardly from the lower end of said rear portion;

said arm portion including a first upwardly extending horizontally elongated tab having a rearwardly projecting protrusion, a forwardly extending nose segment, and a downwardly and rearwardly extending wire portion having the forward end thereof connected to said nose segment and the rearward end thereof fastened to said vertical rear portion, a second downwardly depending elongated tab formed in said wire portion having a forwardly projecting protrusion and a bag-engaging surface at the rearward end of the tab;

holding means interconnecting said vertical rear portions proximate the upper ends thereof for supporting a stack of bags of a predetermined size therefrom; and means interconnecting each of the forward extending base portions to provide a horizontal support surface, whereby a user is adapted to selectively place the handle loops of the topmost bag from a stack of a predetermined bag size, which when the bag is of a larger size, on a respective one of the first upwardly tabs, or alternatively when the bag is of a smaller shorter size, place the handle loops of the bag on respectively one of the downwardly depending second tabs, such that the bottom of the bag is supportable on said horizontal support surface.

2. A bag holding arrangement as claimed in claim 1, wherein said second elongated tab depending downwardly from said wire portion extends at an incline relative to the horizontal axis.

3. A bag holding arrangement as claimed in claim 2, wherein said incline subtends an angle of about 10° to 30° with the horizontal axis.

4. A bag holding arrangement as claimed in claim 2, wherein said incline subtends an angle of about 15° to 20° with the horizontal axis.

5. A bag holding arrangement as claimed in claim 1, wherein the bag-engaging surface at the rearward end of said second tab has a substantially S-shaped configuration, the handle loop of a bag mounted on said tab having a loop portion engaging in the upper recess formed by said S-shape.

6. A bag holding arrangement as claimed in claim 1, wherein the bag-engaging surface at the rearward end of said second tab includes a vertically upwardly extending wire portion connecting with the rearwardly and downwardly extending wire portion.

7. A bag holding arrangement as claimed in claim 1, wherein said second tab has the forwardly projecting protrusion thereof formed below the forwardly extending nose segment so as to form first and second recesses positioned above each other at the forward end of said arm portion, the handle loops of intermediate-sized bags being engageable in the upper recess and the handle loops of small-sized bags being engageable in the lower recess when mounting bags on said second downwardly depending tabs.

8. A bag holding arrangement as claimed in claim 1, wherein said base portions comprise horizontally extending parallel rails including an upper rail and a lower rail having a support extending upwardly from the rear end of the upper rails with the support terminating at the other end of said wire, said other end being crimped about the support.

9. A bag holding arrangement as claimed in claim 8, wherein a further wire forms a brace member constituting a side-to-side stiffening portion interconnecting the lower ends of the vertical rear portions of said side members.

10. A bag holding arrangement as claimed in claim 9, wherein said horizontal support surface comprises a flat shelf having the outer ends thereof fastened to said lower parallel rails.

11. A bag holding arrangement as claimed in claim 1, wherein said holding means comprises a pair of vertically spaced parallel wires each having outer ends fastened to the vertical rear portion of said side members, and another wire bent to provide a loop extending upwardly from the top one of said pair of wires and to provide a pair of trusses interconnecting said wires, said loop being adapted to suspend a stack of bags therefrom.

* * * * *